US006648545B1

(12) United States Patent
Loarie et al.

(10) Patent No.: US 6,648,545 B1
(45) Date of Patent: Nov. 18, 2003

(54) SYSTEMS FOR DETERRING WALKWAY ABUSE

(75) Inventors: Christopher T. Loarie, San Diego, CA (US); Michael J. Loarie, Escondido, CA (US)

(73) Assignee: Intellicept, El Cajon, CA (US)

( * ) Notice: Subject to any disclaimer, the term of this patent is extended or adjusted under 35 U.S.C. 154(b) by 0 days.

(21) Appl. No.: 09/723,977

(22) Filed: Nov. 28, 2000

Related U.S. Application Data

(63) Continuation-in-part of application No. 09/562,383, filed on May 1, 2000, now abandoned, which is a continuation of application No. 09/122,242, filed on Jul. 24, 1998, now Pat. No. 6,086,286.

(51) Int. Cl.[7] ..... E01C 11/22
(52) U.S. Cl. ..... 404/7; 404/8
(58) Field of Search ..... 404/6, 7, 8, 9, 404/14, 15, 16, 19; 206/453; D8/403; 116/63 R, 205; 248/237; 52/102, 188; 40/612, 903; 16/382, 221

(56) References Cited

U.S. PATENT DOCUMENTS

| | | | | |
|---|---|---|---|---|
| 355,810 A | | 1/1887 | Brown | |
| 1,051,354 A | * | 1/1913 | Strachan | 40/612 |
| 1,066,196 A | | 7/1913 | Fixmer | |
| 1,479,651 A | | 1/1924 | Clements | |
| 1,961,227 A | | 6/1934 | Klick | |
| 2,935,162 A | | 5/1960 | Lindsay | |
| 4,554,616 A | | 11/1985 | McIntosh | |
| 4,582,739 A | | 4/1986 | Givens | |
| 4,813,811 A | | 3/1989 | Adams | |
| 4,877,673 A | | 10/1989 | Eckel et al. | |
| 5,310,279 A | | 5/1994 | Lindner | |
| 5,639,072 A | | 6/1997 | McCall | |
| 5,657,955 A | | 8/1997 | Adams | |
| 6,053,281 A | * | 4/2000 | Murray | 182/113 |
| 6,314,688 B1 | * | 11/2001 | Ford et al. | 52/101 |

FOREIGN PATENT DOCUMENTS

| | | |
|---|---|---|
| AT | 394679 | 5/1992 |
| CH | 627806 | 1/1982 |
| EP | 0403145 | 12/1990 |
| FR | 2726588 | 5/1996 |
| GB | 423097 | 1/1935 |
| GB | 480927 | 3/1938 |
| GB | 511711 | 8/1939 |
| GB | 513358 | 10/1939 |

* cited by examiner

*Primary Examiner*—Thomas B. Will
*Assistant Examiner*—Meredith Petravick
(74) *Attorney, Agent, or Firm*—Stout, Uxa, Buyan & Mullins, LLP; Frank J. Uxa; Linda A. Fox

(57) ABSTRACT

A system for inhibiting a wheeled, personal mobility unit, such as skateboards and in-line skates, from sliding along a surface having two or more surface portions oriented at mutually different angles has at least one part having a contact surface that generally complements the two or more surface portions of the surface. The part also has a body extending from the contact surface and terminating at an exposed surface. The part may have hinges to enable the part to bend and conform to complement the surface. The part may have three dimensional features extending from the contact surface for increased adhesive contact area relative to a flat contact surface. The part is anchored to the surface by way of offset fastening members extending from the contact surface and into a substrate of the surface.

23 Claims, 4 Drawing Sheets

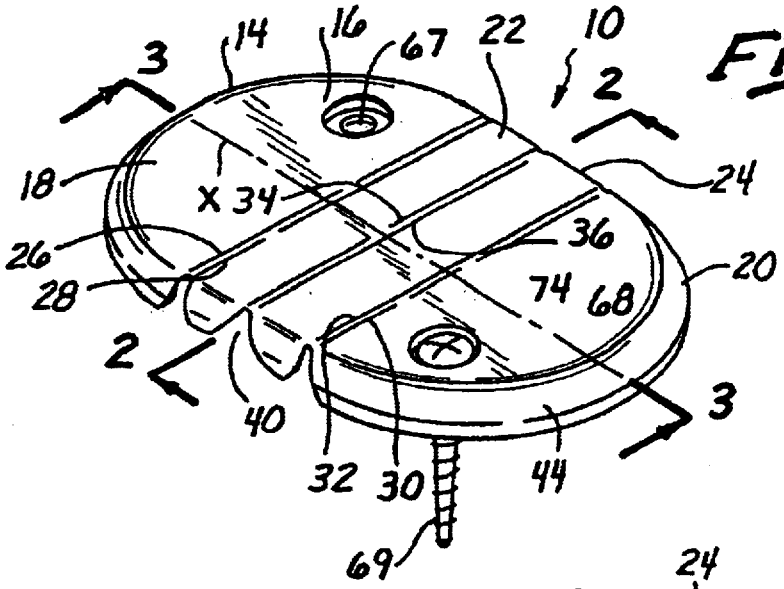
Fig. 1
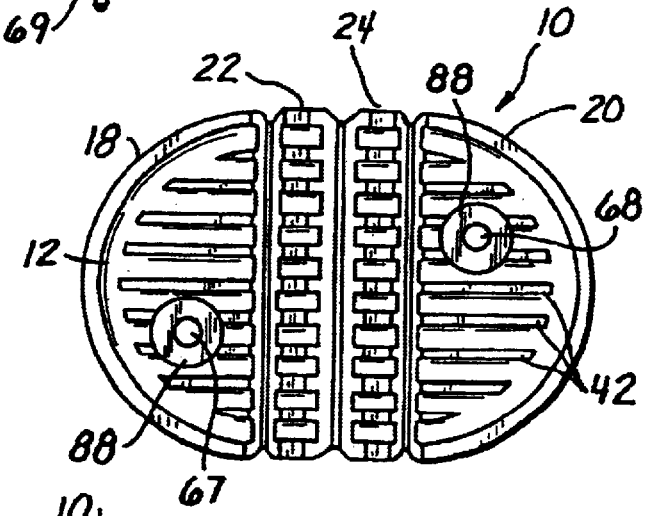
Fig. 4
Fig. 2
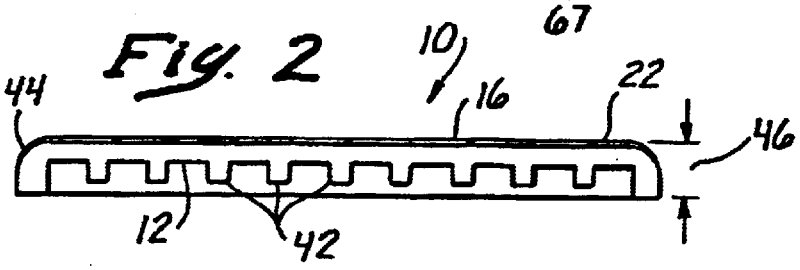
Fig. 3
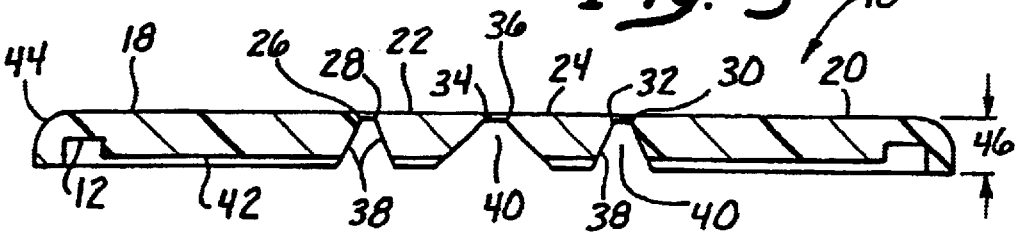

Fig. 5
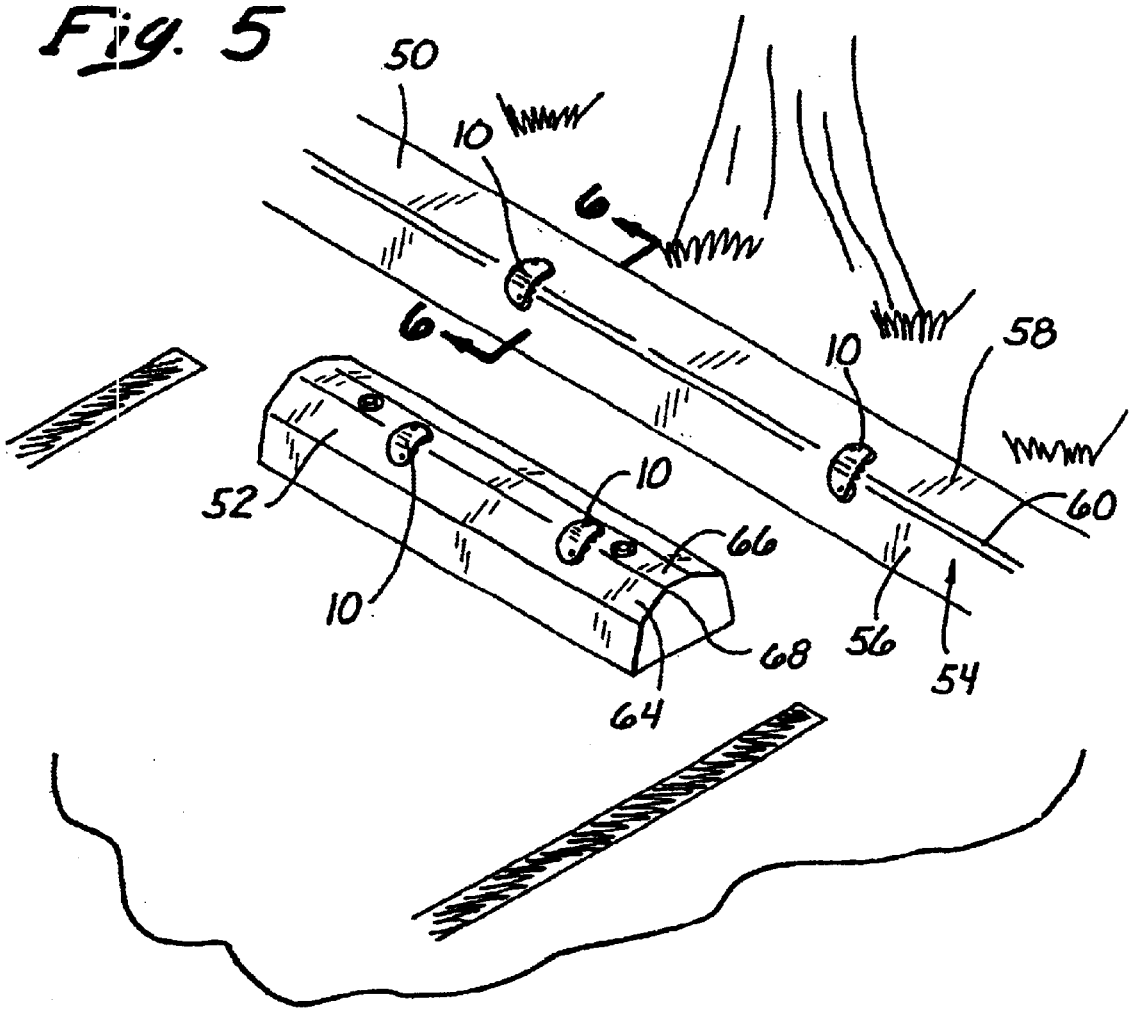
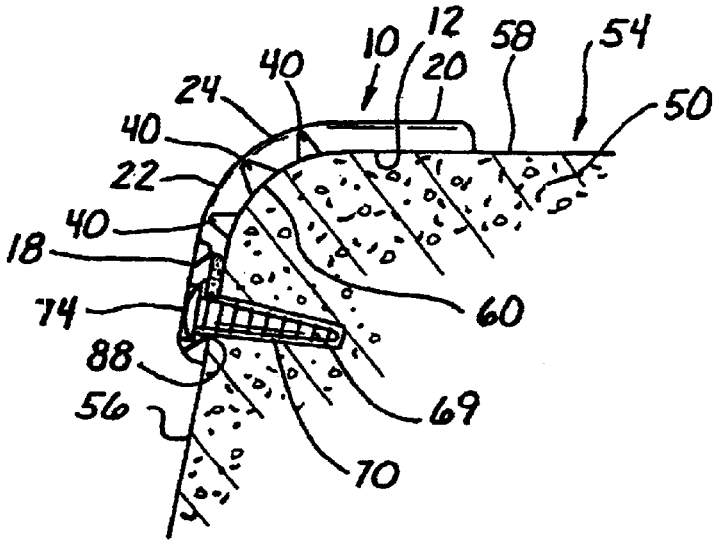
Fig. 6

SYSTEMS FOR DETERRING WALKWAY ABUSE

RELATED APPLICATIONS

The present application is a continuation-in-part of application Ser. No. 09/562,383, filed May 1, 2000, now abandoned, which is a continuation of application Ser. No. 09/122,242 filed Jul. 24, 1998, now U.S. Pat. No. 6,086,286. The disclosure of each of these related applications is incorporated in its entirety herein by reference.

BACKGROUND OF THE INVENTION

1. Field of the Invention

This invention relates generally to inhibiting defacement of curbs, rails, benches and other walkway features and, more particularly, to inhibiting, for example, a wheeled, personal mobility unit, such as a skateboard or in-line skate, from sliding or grinding over such walkway features and the like surfaces.

2. Description of the Related Art

The popularity of skateboarding, in-line skating, and other activities that use wheeled, personal mobility units has increased, and continues to increase. Professional, televised competitions, along with personal appearances and shows by expert skateboarders and in-line skaters abound. Recreational parks specially built for these activities provide controlled yet challenging areas for the practitioners of these activities.

Not all skateboarders and in-line skaters practice their sport in ways that are respectful of people or property. The general public, as well as local merchants, church officials, school administrators, and public administrators, have complained regarding the behavior of skate boarders and skaters in the community. Some of the complaints concerned the skateboarders and skaters using the curbs, benches, and sidewalk edges to practice and perfect stunts. As a result, the general tranquility was disturbed, property owners endured real property damage, local merchants observed reduced customer traffic, and concern was expressed with a perceived increase in liability associated with personal injury and/or property damage.

A stunt commonly performed by skateboarders and in-line skaters is to slide or grind along non-planar or multi-angled surfaces, such as curb edges, park bench edges, and handrails. A general solution to the problem is to interrupt the surfaces that are the target for sliding.

A specific solution in the prior art concerning sliding along curb edges involves placing additional curbs in a zig-zag pattern along the curb edge. The apexes on one side of the zig-zagged additional curbs form a line that is parallel to the curb edge, but the apexes are only near the edge and not co-extensive with the edge. This arrangement results in insufficient area about the curb edge for sliding. However, the placement of the additional curbs is expensive, bulky, and unattractive.

A specific solution in the prior art concerning sliding along bench edges places disc-like units on the horizontal surface of the bench. The disc-like units are placed in a row parallel to the bench edge, but the row is only near the edge and not co-extensive with the edge. Again, this arrangement results in insufficient area about the bench edge for sliding. However, the disc-like units are appropriate for placement on planar or flat surfaces. Further, the skateboarders and in-line skaters slide along the edge and the solutions in the prior art do not directly address interrupting the sliding edge.

Therefore, a system and process for inhibiting a wheeled, personal mobility unit, such as skateboards and in-line skates, from sliding along surfaces having portions oriented at mutually different angles, for example, curb, bench and sidewalk edges, is needed.

SUMMARY OF THE INVENTION

An objective of the invention is to provide a system for inhibiting sliding or grinding along a surface having two or more surface portions oriented at mutually different angles. The present systems very effectively inhibit such activities, for example, using wheeled, personal mobility units, such as skateboards and in-line skates, which result in reduced bodily injuries and property damage, and an increase in the overall tranquility. The present systems are straightforward in design and construction, can be adapted to various surfaces and are cost effective to manufacture and use. Moreover, the systems can be used without substantially disrupting the functionality and attractiveness of the surface. In general, the present systems comprise at least one part, and often a plurality of parts, having a contact surface that generally complements, or conforms to, the two or more angled surface portions of the surface. The part also has a body, for example, a substantially incompressible body, extending from the contact surface and terminating at an exposed surface. The part preferably is permanently secured to the surface, for example by one or more mechanical fasteners, or anchor members. Additionally, or alternatively an adhesive, such as a conventional epoxy adhesive, may be located adjacent the contact surface and is effective in securing the part to the surface.

In one aspect of the invention, the body includes first and second body portions. The body portions each include an aperture for receiving a fastening member, for example a bolt, screw, or other fastening member suitable for installing the part to the surface. Preferably, the apertures are oversized with respect to the fastening member to allow for error, for example drilling error, during the installation process, as well as allow for expansion or contraction of the part and/or substrate to which the part is fastened.

Notably, if the apertures are positioned on the body portions such that the fasteners received therethrough meet one another or occupy a common plane, the substrate may be weakened and become brittle after the part has been installed. In one advantageous embodiment of the invention, the apertures are offset with respect to one another in order to prevent the fastening members from occupying the same special plane and/or meeting each other when received by the first and second body portion apertures. Preferably, the apertures are spaced apart from a generally central axis defined by the part, and are located on opposing sides of the generally central axis.

In another aspect of the invention, the part is adapted to withstand compressive forces, particularly about the body portion apertures, for example, forces exerted on the part during installation of the part to a concrete substrate. For example, a substantially solid ring of material is provided about each of the apertures. When the part is installed to a concrete substrate for example, a head of the fastening member rests on the substantially solid ring. As the fastener is tightened to the substrate, the ring functions to strengthen the part and prevent the part from becoming weakened and/or deforming and/or breaking.

In one embodiment of the invention, the part comprises a substantially solid, unitary structure and the body portions define a fixed angle of orientation conforming to the surface having mutually different angles, for example, positioned at an angle of about 90° or about 60° or about 45° or about 30° relative to each other. Such "fixed angle" parts are advantageously made of metal, such as steel, aluminum, and/or other metals.

In another embodiment of the invention, the body portions are flexibly connected to each other. For example, body portions are joined by a hinge assembly. Thus, in this embodiment, the body is adapted to bend about the hinge assembly to conform to at least two of the surface portions. In one particularly useful embodiment, the hinge assembly comprises first and second hinges. The first hinge is flexibly connected to the first body portion. The second hinge is flexibly connected to a second body portion. The two hinges are flexibly connected or joined. The contact surface preferably extends over the body portions and the hinges. The part is flexible about the hinges thereby enabling the contact surface to conform to a multi-angled surface.

The contact surface of the part may be a planar, flat, substantially featureless surface. Parts made of one or more metals advantageously have such a surface. In another aspect of the invention, the part has one or more three dimensional features extending from the contact surface for providing an increased adhesive contact area relative to a flat contact surface. Thus, the part may be adhered to the surface by a layer of adhesive between the contact surface and the surface, in addition to being secured to the surface by the fastening members received through the body portion apertures as described briefly hereinabove.

A plurality of the parts as described elsewhere herein can be packaged and sold together. A plurality of such parts can be placed at spaced apart intervals along a surface to inhibit unwanted sliding along the surface, as described elsewhere herein.

In a further aspect of the invention, a process for inhibiting sliding along a surface having two or more surface portions oriented at mutually different angles comprises the step of providing a part that has a contact surface that generally complements the surface, such as the parts described elsewhere herein. The part is secured, preferably permanently secured, to at least one of the surface portions.

Any combination of two or more features described herein are included within the scope of the present invention provided that the features in each such combination are not mutually inconsistent.

These and other aspects and advantages of the present invention are apparent in the following detailed description and claims, particularly when considered in conjunction with the accompanying drawings in which like parts bear like reference numerals.

BRIEF DESCRIPTION OF THE DRAWINGS

FIG. 1 is an isometric view of a double hinged part that conforms to complement a variety of surfaces having differently angled portions according to an embodiment of the invention, and includes apertures offset from each other for receiving spaced apart fastening members;

FIGS. 2 and 3 are sectional views of the double-hinged part shown in FIG. 1;

FIG. 4 is a bottom view of the double-hinged part shown in FIG. 1;

FIG. 5 shows double hinged parts of shown in FIG. 1 adhered to curbs;

FIG. 6 is a sectional view of one of the double hinged parts of FIG. 5 shown conforming to complement the rounded corner of the curb;

DETAILED DESCRIPTION OF THE PREFERRED EMBODIMENTS

Figure 7:
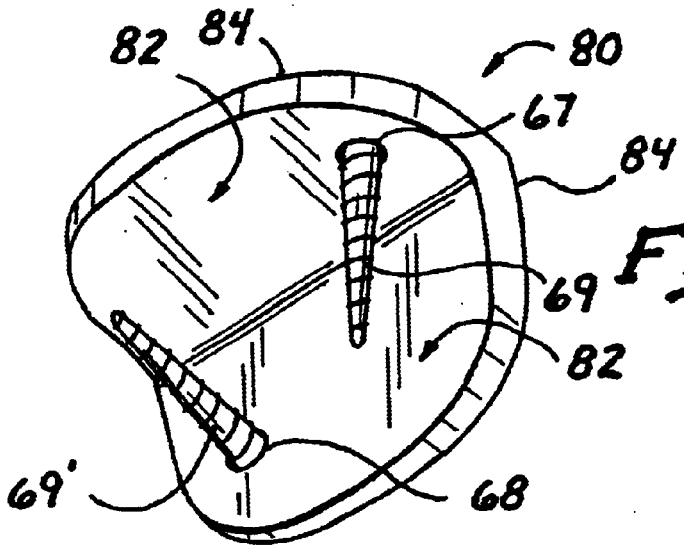
FIG. 7 is an isometric view of a solid part that complements a right angled surface according to an embodiment of the invention, and includes a planar contact surface and offset fastening members occupying different planes.

Referring now to FIGS. 1 through 4, a double hinged part 10 has an approximately oval shape, when placed in a flat position, and comprises a contact surface 12 with a body 14 extending therefrom. The body 14 terminates in an exposed surface 16. The body 14 is comprised of first and second body portions 18 and 20 with first and second hinges 22 and 24 disposed therebetween.

The body 14 may be comprised of a substantially incompressible material, such as a metal, thermoset plastic, thermoplastic polymer, hard rubber, or wood. Other embodiments of the invention may have a body 14 that is comprised of a relatively compressible material, such as a relatively soft rubber or other polymer or even a polymeric foam. In an embodiment of the invention, the body 14 is made from a unitary piece of plastic or polymeric material. Other embodiments of the invention may be assembled from multiple parts, and/or the parts may have different compositions.

The body portions 18 and 20 and the hinges 22 and 24 are flexibly attached to enable the contact surface 12 to conform to complement a variety of surfaces having differently angled portions, for example, a surface which forms an edge (see FIGS. 5 and 6). More specifically, the first body portion 18 has a first body portion hinge edge 26 that is flexibly connected to a first edge 28 of the first hinge 22. Further, the second body portion 20 has a second body portion hinge edge 30 that is flexibly connected to a first edge 32 of the second hinge 24. The first hinge 22 has a second edge 34 that opposes the first hinge first edge 28. The second hinge 24 has a second edge 36 that opposes the second hinge first edge 32. The second hinge edges 34 and 36 are flexibly connected.

The shown embodiment of the invention has two hinges 22 and 24. Other embodiments of the invention may include no hinges, one hinge or more than two hinges.

In the shown embodiment of the invention, adjacent walls 38 of the body portions 18 and 20 and the hinges 22 and 24 are beveled away from the edges 26, 28, 30, 32, 34, and 36. The adjacent walls define a v-gap 40 between the adjacent sections of the double hinged part 10. The v-gaps 40 enable the double hinged part 10 to bend about the hinges and conform to complement a surface having two or more surface portions oriented at mutually different angles or a surface having two or more angularly oriented surface portions (see FIGS. 5 and 6). Other embodiments of the invention may have only one of a pair of adjacent walls being beveled. Other embodiments of the invention may not have beveled adjacent walls, with the hinge configuration being such that the part 10 may still conform to complement a multi-angled surface.

The part 10, in the shown embodiment of the invention, comprises three dimensional features 42 extending from the contact surface 12 in a plurality of rows. The three dimensional features 42 provide an increased adhesive contact area relative to a flat contact surface, thereby improving adhesion of the part 10 to a surface (see FIG. 6). Other embodiments of the invention may have a part with three dimensional features of other shapes and configurations, or a flat, relatively featureless contact surface.

In the shown embodiment, the flexibly attached pairs of edges 26 and 28, 30 and 32, and 34 and 36 are co-extensive, but other embodiments of the invention may have pairs of edges that are not co-extensive. Further, while the shown embodiment of the invention is symmetrical about a number of axes (not shown), other embodiments of the invention may not be symmetrical and the body portions 18 and 20 and the hinges 22 and 24 may be of any suitable configuration or shape. The shown embodiment of the invention has a rounded edge 44 about the perimeter of the part 10. Other embodiments of the invention may have perimeter edges of other shapes. The shown embodiment of the invention has a relatively shallow height 46 resulting in a low profile. Other embodiments of the invention may have other heights, varying heights, and different profiles.

Referring now to FIG. 5, the double hinged parts 10 are attached to a poured curb 50 and an installed curb 52 to inhibit wheeled, personal mobility units, such as skateboards and in-lines skates, from sliding on the curbs. Referring now to FIG. 6 as well, the curb 50 has a surface 54 with two surface portions 56 and 58 oriented at different angles (approximately at a right angle to each other) that meet at a rounded corner 60. The part 10 has been bent about the hinges 22 and 24 to conform and complement the surface portions 56 and 58 and the rounded corner 60. Attention is directed to the v-gaps 40 which have narrowed with the bending of the part 10. The parts 10 are similarly attached to the installed curb 52, with the parts conforming to complement a surface 62 with two surface portions 64 and 66 oriented at different angles that meet at a relatively sharp corner 68.

In the shown embodiment of the invention, the parts 10 are attached to distinct surface portions 56, 58, 64, and 66 that meet at an angle. Other embodiments of the invention may have the surface portions being less distinct. One example of such a surface is a cylindrical rail (not shown). As such, surface portions oriented at mutually different angles or angularly oriented surface portions shall include distinct surface portions, rounded surface portions, and cylindrical surface portions for the purposes of defining the present invention.

Turning back now to FIGS. 1 and 4, in one particularly advantageous aspect of the invention, means, defined in the first and second body portions 18 and 20, are provided for enabling the part 10 to be mechanically secured, or anchored, to the surface. More specifically, in the embodiment shown, the part 10 includes a first aperture 67 in the first body portion 18 and a second aperture 68 in the second body portion 20, both apertures 67 and 68 being configured and sized for receiving a fastening member (not shown in FIGS. 1 and 4) in a substantially perpendicular orientation with respect to the contact surface 12. The fastening member may comprise, for example a pin, bolt, nails, screw, mounting stud or other member that is suitable for securely and permanently anchoring the part 10 to cement or other substrate to which the part 10 is to be fastened. Attention is briefly directed again to FIG. 6, which shows the part 10 anchored to a cement curb 50 for example by means of a threaded bolt 69 inserted through first body portion aperture 67 and a bore 70, for example a bore 70 that has been drilled into the cement curb 50.

Importantly, the first and second body portion apertures 67 and 68 are offset from one another. Turning now to FIG. 7, it is shown that with this particular offset arrangement of apertures 67 and 68, fastener member 69 received in the first body portion aperture 67 does not meet, contact or even occupy the same planar space as another similar or identical fastener member 69' that is received in the second body portion aperture 68. Thus, when each bore is drilled into the curb for example, the bores (and the fastener members 69) will not meet each other, which could otherwise weaken the cement substrate and cause the curb to break or become brittle over time.

Attention is directed to FIG. 7 which shows another embodiment 80 of the invention in which the part 82 is a solid, fixed angle part 82 rather than the hinged part 10 hereinabove described and shown in FIGS. 1–4. Similar to the embodiment 10 shown in FIGS. 1–4, this embodiment 80 includes apertures 67 and 68 offset from one another such that fastening members 69 will not meet and will be substantially spaced apart from one another.

In the shown embodiments 10, 80 the apertures 67 and 68 are located on opposing sides of, and spaced apart from, a generally central axis(represented by dashed line X in FIG. 1) defined through the first and second body portions 18 and 20. In addition, in both of the shown embodiments 10, 80, the apertures 67 and 68 are arranged so that bolts 69 will occupy spacially distinct planes when the part is installed.

It is to be appreciated that although the parts 10 and 80 shown each include only two apertures 67 and 68 for receiving fastening members 69, other embodiments of the invention may include any other suitable number of apertures and arrangement thereof, providing, however that the apertures are positioned and/or arranged in a manner that ensures that the part 10 will be firmly anchored to the surface without compromise to the strength of the substrate 50 to which the part 10 has been fastened.

Preferably, each of the apertures 67 and 68 has a diameter larger than a diameter of the fastening members to be inserted therethrough. For example, the first and second body portion apertures 67 and 68 may each have a diameter of about 5/16th of an inch, and the fastener members 69 may comprise bolts having a diameter of about ¼ of an inch. The apertures 67 and 68 are preferably oversized to allow for error in drilling of the concrete, on the part of the installer, as well as allow for expansion or contraction of the substrate and/or the part 10 without causing substantial stress of the part 10 or substrate.

In the embodiment shown in FIG. 4, in which the contact surface 12 includes three dimensional features 42, the part 10 preferably includes a substantially solid ring 88 of material defined about each of the first and second body portion apertures 67 and 68, for relieving stress on the part 10 when the part 10 is being fastened to the surface. More specifically, in this embodiment, it is preferable that any recessed or grooved areas (which define the three dimensional features 42) do not extend into an area immediately adjacent the apertures 67 and 68, thus leaving the solid ring 88 of material, having a diameter of, for example, about 5/8th of an inch.

Referring now to FIG. 1, when the fastener 69 is placed through the part 10, a head 74 of the fastener 69 will rest on the ring 88. The solid ring 88 substantially prevents the part 10 from deforming and/or breaking as the fastener 69 is tightened to the substrate 50. This feature is particularly important when the part 10 is made of plastic or other material that might tend to fracture under compressive stressors.

Referring specifically now to FIG. 6, in addition to the mechanical fastening means hereinabove described, a layer of adhesive 70 may be provided between the contact surface 12 and the surface 54. Any suitable adhesive, for example, conventional epoxy adhesives and the like, may be used to attach the part 10 to the surface 54. Other embodiments of the invention may use other less permanent means of attaching the part 10 to the surface 54. However, these less permanent means would be designed such that only designated people may remove part 10. An example of such a less permanent means is a system that employs a special tool, that is not readily available to those not authorized to remove the parts, to remove the parts (not shown).

Referring now to FIG. 7, the part 80 of the shown embodiment includes a contact surface 82 having a fixed angle, for example a right angle, for conforming to a right angle surface. Other parts may have other fixed angles for conforming to different angular surfaces.

As shown, the contact surface 82 may comprise a substantially smooth, planar, substantially featureless contact surface 82, relative to the three dimensional contact surface 12 shown in FIG. 4. Although not shown, it will be appreciated that the fixed angle part 80 may alternatively include three dimensional features for providing an increased adhesive contact area. The three dimensional features may comprise grooves, nodes, projections, texturing or the like for providing an increased adhesive contact area.

A body 84 of the part 80 extends from the contact surface 82 and terminates in a partially spherical exterior surface 84. Other embodiments of the invention may have exterior surfaces of other shapes.

The body 84 may be comprised of a substantially incompressible material, such as described elsewhere herein. Other embodiments of the invention may have a body 84 that is comprised of a relatively compressible material, such as described elsewhere herein. In an embodiment of the invention, the body 84 is made from a unitary piece of plastic. Other embodiments of the invention may be assembled from multiple parts, and the parts may have different compositions.

Figure 8:
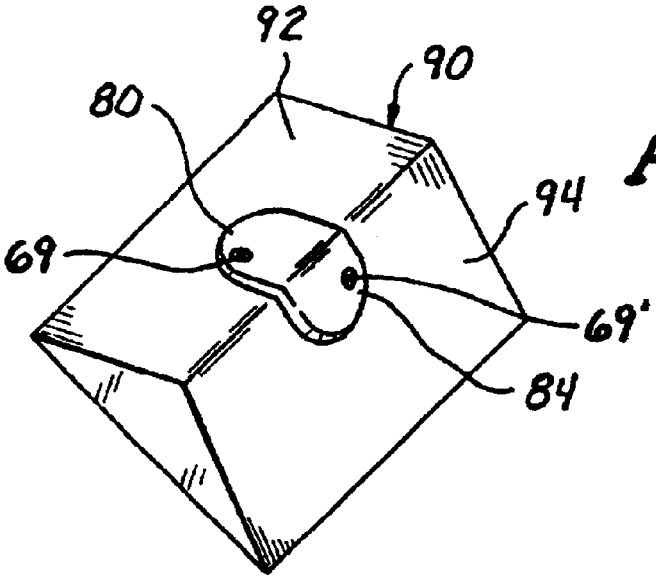
FIG. 8 is an isometric view of the solid part shown in FIG. 7 attached to a right angled surface.
Figure 9:
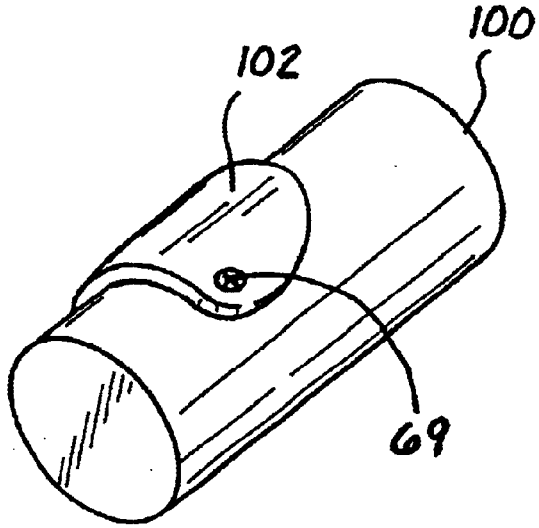
FIG. 9 is an isometric view of a solid part mounted to a cylindrically shaped surface according to an embodiment of the invention.

Referring now to FIG. 8, the solid part 80 is shown attached and permanently secured to a right-angled surface 90 by means of offset bolt fasteners 69. The contact surface 82 of the solid part 80 complements surface portions 92 and 94 of the surface 90 as the surface portions are oriented at a right angle. Other embodiments of the invention may have parts that complement surface portions that meet at other angles or configurations. For example, in the embodiment of the invention shown in FIG. 9, the surface 100 is cylindrical. A part 102 is similar to part 80 but for the contact surface (not shown) being rounded to complement the cylindrical surface 100.

Figure 10:
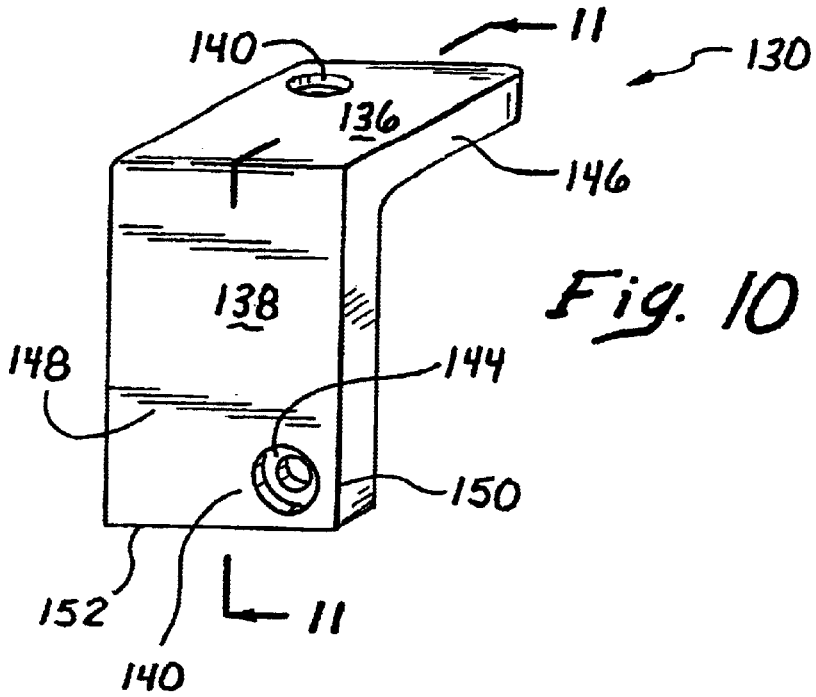
FIG. 10 is an isometric view of a solid part that complements a right angled surface according to another embodiment of the invention.
Figure 11:
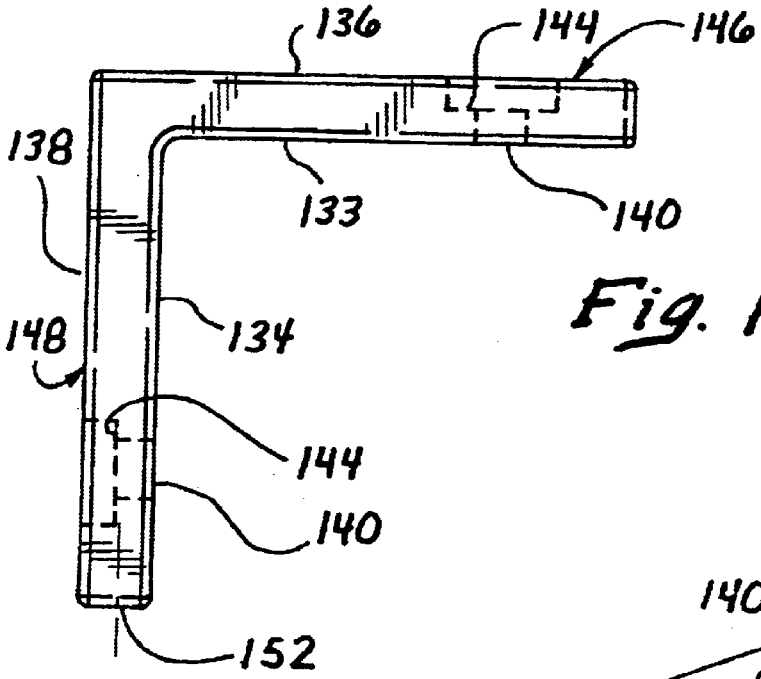
FIG. 11 is a cross sectional view of the solid part taken across line 11—11 of FIG. 10.

A part 130 in accordance with another advantageous embodiment of the invention is shown in FIGS. 10 and 11. This embodiment is similar to the part 80 shown in FIG. 7. A right angled contact surface 132 is defined by intersecting planar contact surface portions 133, 134. Rather than the curved, partially spherical exterior surface shown in FIG. 7, the part 130 shown in FIGS. 10 and 11 includes generally flat, planar, substantially rectangular exposed surfaces 136, 138 that complement two flat, planar surfaces of a curb (not shown) for example. Preferably, in this embodiment, the part 130 is made of a metal, for example aluminum by extrusion methods.

Means for securing the part 130 to an angled surface includes offset apertures 140 located on generally rectangular body portions 146, 148. Each aperture 140 is adapted to receive a bolt (not shown) or other suitable fastening member. The apertures 140 may be recessed as shown. More particularly, each aperture 140 is further adapted to receive a washer, for example, between a head of the bolt and a recessed ring-shaped surface 144.

As a specific example of the part 130, each rectangular surface 136, 138 has dimensions of about 2.0 inches by about 3.0 inches, and each body portion 146, 148 has a thickness of about 0.375 inches extending from contact surface. In addition, each aperture 140 is spaced at about 0.75 inches from edges 150, 152 of body portions 146 148 as shown. Ring surface 144 is recessed about 0.20 inches from exposed surface 136, 138.

Figure 12:
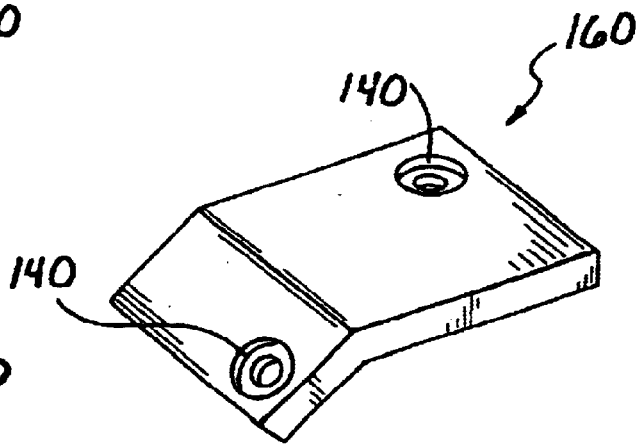
FIG. 12 is an isometric view of a solid part that complements a 135 degree angled surface according to another embodiment of the invention.

Turning now to FIG. 12, another part 160 in accordance with the present invention is shown. This part 160 is similar to part 130 shown in FIGS. 10 and 11, however, this part 160 is adapted to be secured to an angled surface having an angle of about 135 degrees. It is to be appreciated that other parts in accordance with the present invention can have various sizes and shapes and be adapted to accommodate a variety of angled surfaces.

While the description above refers to particular embodiments of the present invention, it will be understood that many modifications may be made without departing from the spirit thereof. Further, aspects of the invention may have combinations of the above described embodiments although these combinations may not be explicitly described. The accompanying claims are intended to cover such embodiments as would fall within the true scope and spirit of the present invention.

What is claimed is:

1. A system for deterring unwanted activity along an angled surface susceptible to sliding of a personal mobility vehicle therealong, the system comprising at least one part structured to be secured across an apex of the angled surface, the at least one part comprising:

a contact surface that generally complements the angled surface;

a body extending from the contact surface and terminating at an exposed surface, the body comprising a first body portion and a second body portion;

a first aperture defined in the first body portion structured to receive a first fastener defining a first longitudinal axis; and a second aperture defined in the second body portion structured to receive a second fastener defining a second longitudinal axis;

the first body portion aperture and the second body portion aperture being offset with respect to one another such that when the part is installed to the angled surface using the first and second fasteners in the first and second apertures respectively, the first fastener longitudinal axis and the second fastener longitudinal axis are not located in any common plane;

the at least one part, when secured to the angled surface, being effective to add sufficient relief to the angled surface to inhibit sliding of a skate, skateboard, or in-line skate therealong, and the at least one part including no additional aperture structured to receive a fastener.

2. The system of claim 1 further comprising the first and second fasteners, and wherein the first and second body portion apertures have a diameter larger than a diameter of the first and second fasteners, respectively.

3. The system of claim 1 wherein the contact surface comprises three dimensional features for providing an increased adhesive contact area relative to a flat contact surface.

4. The system of claim 1 wherein the part further comprises first and second substantially solid rings of material, defined about each of the first and second body portion apertures, respectively, for relieving stress on the part when the part is fastened to the surface.

5. The system of claim 1 wherein the at least one part is structured so that when secured to the angled surface the at least one part is effective to provide sufficient relief to the angled surface to inhibit sliding of a skate, skateboard or in-line skate therealong without otherwise substantially altering an appearance of the angled surface.

6. The system of claim 1 including a plurality of the at least one part.

7. The system of claim 1 wherein the at least one part further comprises a hinge assembly for flexibly connecting the first and second body portions and the body is adapted to bend about the hinge assembly to substantially conform to the angled surface.

8. The system of claim 1 wherein the at least one part comprises a unitary structure with the first body portion and the second body portion defining a fixed angle substantially conforming to the angled surface.

9. The system of claim 8 wherein the at least one part comprises a unitary, substantially metal structure.

10. A system for deterring skateboard activity along an angled surface susceptible to sliding of a skate, skateboard, or in-line skate therealong, the system comprising:

a plurality of parts structured to be secured at spaced-apart intervals along the angled surface and across an apex of the angled surface, each of said plurality of parts comprising;

a contact surface that generally complements the angled surface;

a body extending from the contact surface and terminating at an exposed surface, the body comprising a first body portion and a second body portion;

a first aperture defined in the first body portion structured to receive a first fastener defining a first longitudinal axis; and a second aperture defined in the second body portion structured to receive a second fastener defining a second longitudinal axis; the first body portion aperture and the second body portion aperture being offset with respect to one another such that when the part is installed to the angled surface using the first and second fasteners in the first and second apertures respectively, the first fastener longitudinal axis and the second fastener longitudinal axis are not located in any common plane;

said plurality of parts, when secured to the angled surface at said spaced-apart intervals, being effective to add sufficient relief to the angled surface to inhibit sliding of a skate, skateboard or in-line skate therealong, and each of said plurality of parts including no additional aperture structured to receive a fastener.

11. The system of claim 10 further comprising the first and second fasteners, and wherein the first and second body portion apertures have a diameter larger than a diameter of the first and second fasteners, respectively.

12. The system of claim 10 wherein the contact surface includes three dimensional features for providing an increased adhesive contact area relative to a flat contact surface.

13. The system of claim 10 wherein each of the parts further comprises first and second substantially solid rings of material respectively, about the first and second body portion apertures, for relieving stress on the part when the part is fastened to the surface.

14. The system of claim 10 wherein said plurality of parts are structured so that, when secured to the angled surface, the parts provide sufficient relief to the angled surface to inhibit sliding of a skate, skateboard or in-line skate therealong without otherwise substantially altering an appearance of the angled surface.

15. The system of claim 10 wherein each of the plurality of parts further comprises hinge assembly for flexibly connecting the first and second body portions and the body is adapted to bend about the hinge assembly to conform to the at least two of the surface portions.

16. The system of claim 10 wherein each of the plurality of parts comprises a unitary structure with the first body portion and the second body portion defining a fixed angle substantially conforming to the angled surface.

17. The system of claim 16 wherein each of the plurality of parts comprises a unitary, substantially metal structure.

18. A system for inhibiting sliding of a personal mobility unit along a surface having two or more angularly oriented surface portions, the system-comprising at least one part comprising:

a contact surface that generally complements the two or more surface portions of the surface;

a substantially solid angled body extending from the contact surface and comprising a first body portion including a first aperture for receiving a fastener, and a second body portion including a second aperture for receiving a fastener and, other than the first aperture and the second aperture, the exposed surface being substantially flat and featureless;

a first fastener received in the first aperture and defining a first longitudinal axis; and a second fastener received in the second aperture and defining a second longitudinal axis;

the first fastener and the second fastener being offset from one another such that when the part is installed to the two or more angularly oriented surface portions using the first and second fasteners, the first fastener longitudinal axis and the second fastener longitudinal axis are not located in any common plane, and the at least one part including no additional aperture for receiving a fastener.

19. The system of claim 18 wherein the contact surface includes three dimensional features for providing an increased adhesive contact area relative to a flat contact surface.

20. The system of claim 18 including a plurality of the at least one part.

21. The system of claim 18, wherein the at least one part includes a first aperture and a second aperture, and the first and second fasteners are disposed through a first aperture and a second aperture, respectively.

22. A process for deterring skateboard activity along an angled surface susceptible to sliding of a skateboard therealong, the process comprising the steps of:

providing a plurality of parts, each of said plurality of parts comprising a contact surface that generally complements the angled surface and a body extending from the contact surface and terminating at an exposed surface; and securing the plurality of parts at spaced apart intervals along the angled surface and across an.apex of the angled surface, the step of securing including installing through the first body portion a first fastener defining a first longitudinal axis and installing through the second body portion a second fastener defining a second longitudinal axis, such that the first fastener longitudinal axis and the second fastener longitudinal axis are offset such that they are not located in any common plane;

the step of securing including securing no additional fastener having a longitudinal axis other than the first fastener and the second fastener;

said steps of providing and securing being effective to add sufficient relief to the angled surface to inhibit sliding of a skateboard therealong.

23. The process of claim 22 wherein the step of securing comprises providing a first aperture in the first body portion, and a second aperture in the second body portion, for receiving the first and second fasteners, respectively.

* * * * *